US010352082B1

(12) United States Patent
Shuba, Jr.

(10) Patent No.: US 10,352,082 B1
(45) Date of Patent: Jul. 16, 2019

(54) DOOR STOP

(71) Applicant: William Shuba, Jr., Canonsburg, PA (US)

(72) Inventor: William Shuba, Jr., Canonsburg, PA (US)

( * ) Notice: Subject to any disclaimer, the term of this patent is extended or adjusted under 35 U.S.C. 154(b) by 0 days.

(21) Appl. No.: 15/810,179

(22) Filed: Nov. 13, 2017

(51) Int. Cl.
*E05F 5/02* (2006.01)
*E05F 5/08* (2006.01)

(52) U.S. Cl.
CPC ..... *E05F 5/08* (2013.01); *E05Y 2201/224* (2013.01); *E05Y 2600/51* (2013.01); *E05Y 2900/132* (2013.01)

(58) Field of Classification Search
CPC ..... Y10T 16/61; Y10T 16/628; Y10T 16/625; Y10T 16/6285; E05F 5/00; E05F 5/003; E05F 5/006; E05F 5/02; E05F 5/022; E05F 5/06; E05F 5/08; F16F 1/44; F16F 1/445; F16F 1/3732; F16F 1/3735; B60G 69/001; B60G 2204/4502; E05Y 2201/224; E05Y 2600/51; E05Y 2900/132
See application file for complete search history.

(56) References Cited

U.S. PATENT DOCUMENTS 383,809 A * 5/1888 Herrick ..... E05F 5/06 16/86 A
1,354,469 A * 10/1920 Daniele ..... E05F 5/06 16/86 A
1,394,889 A 10/1921 Foedisch et al.
1,923,933 A * 8/1933 Kartzmark ..... E05C 17/52 16/85
2,189,048 A * 2/1940 Underhill ..... E05F 5/06 16/86 A
2,230,598 A * 2/1941 Mason ..... E05C 17/52 292/70
2,449,687 A 9/1948 Brinda
2,454,414 A * 11/1948 Taylor ..... E05C 17/525 16/86 A
2,479,597 A 8/1949 Anton
2,761,718 A * 9/1956 Tool ..... E05C 17/56 16/85
2,767,005 A * 10/1956 Jorgensen ..... E05C 19/066 16/86 A
2,815,236 A * 12/1957 Lowinski ..... E05C 17/56 292/251.5
3,086,803 A * 4/1963 Wilson ..... E05C 19/063 16/85
3,160,912 A * 12/1964 Heyer ..... E05F 5/06 16/85
3,172,144 A * 3/1965 Jamison ..... E05F 5/06 16/86 A
3,180,666 A 4/1965 Jorgensen
3,300,239 A * 1/1967 Dinkin ..... E05C 17/56 292/251.5
3,466,748 A * 9/1969 Christensen ..... A61C 8/0022 433/189

(Continued)

FOREIGN PATENT DOCUMENTS

DE 3006856 A1 * 9/1981 ..... E05F 5/06
FR 2790279 A1 * 9/2000 ..... E05C 17/525
JP 09228732 A * 9/1997

*Primary Examiner* — Chuck Y Mah
(74) *Attorney, Agent, or Firm* — Cramer Patent & Design, PLLC; Aaron R. Cramer

(57) ABSTRACT

A door stop includes a first end capable of self-engaging and securing into a support structure adjacent a doorway and a second end having a driving tool adapting means. The driving tool adapting means may, in certain embodiments, involve a single notch, a cross-notch, a cube, a pentagonal tube or a hexagonal tube, capable of receiving conventional driving tools.

3 Claims, 5 Drawing Sheets

(56) References Cited

U.S. PATENT DOCUMENTS

| | | | | | |
|---|---|---|---|---|---|
| 3,864,785 | A * | 2/1975 | Hoppock | E05F 5/06 | 16/86 A |
| 4,218,807 | A | 8/1980 | Snow | | |
| 4,477,217 | A * | 10/1984 | Bonacorsi | F16B 25/0031 | 411/387.4 |
| 4,782,553 | A * | 11/1988 | Morrison | E05F 5/02 | 16/86 A |
| 5,575,514 | A * | 11/1996 | Troy | E05C 17/52 | 292/203 |
| 5,887,917 | A * | 3/1999 | Luciana | E05C 17/56 | 16/82 |
| 7,210,255 | B2 * | 5/2007 | Blackburn | A47G 3/00 | 40/209 |
| 9,136,037 | B1 * | 9/2015 | Gallagher | H01B 3/307 | |
| 9,267,317 | B2 * | 2/2016 | Vu | E05F 5/06 | |
| 9,279,442 | B2 * | 3/2016 | Naylor | F16B 37/14 | |
| 9,907,592 | B2 * | 3/2018 | Meyer, III | A61B 17/8635 | |
| 9,915,088 | B2 * | 3/2018 | Catalano | E05F 5/06 | |
| 2006/0021191 | A1 * | 2/2006 | Huang | E05F 5/06 | 16/82 |
| 2006/0285940 | A1 * | 12/2006 | Walther | F16B 25/0026 | 411/421 |
| 2009/0136319 | A1 * | 5/2009 | Panasik | F16B 25/0031 | 411/404 |
| 2009/0148254 | A1 * | 6/2009 | Carrillo, Sr. | F16B 23/0023 | 411/404 |
| 2013/0255033 | A1 | 10/2013 | Vu | | |
| 2015/0176623 | A1 * | 6/2015 | Vogel | F16B 25/0021 | 411/387.4 |
| 2016/0186794 | A1 * | 6/2016 | Belinda | F16B 25/0015 | 411/387.1 |

* cited by examiner

DOOR STOP

RELATED APPLICATIONS

Not applicable.

FIELD OF THE INVENTION

The present invention relates to a door stop capable of being installed with a driving a tool.

BACKGROUND OF THE INVENTION

The common door stop has been used for generations to stop doors from swinging too far and damaging walls. It is typically installed in the baseboard where its straightforward design work amazing well time after time without any thought. Perhaps the only real difficulty associated with its use is with its initial installation. While the underlying process of screwing it in to the baseboard is simple, the actual act is often not. Due to its cylindrical shape, it is difficult to grasp and turn in to the baseboard, especially when said baseboards are made of hardwoods. Should a pair of pliers be used to provide increased leverage, marring of the fine finished surface is sure to result. Some manufacturers have responded with a square or hexagonal surface upon which a wrench can be used, but such appendages interrupt sleek modern lines and are not aesthetically pleasing. The same problems exist when trying to remove the same door stops for painting or other remodeling needs.

Further, installing such door stops are difficult to do depending on the material of the wall or floor that it is to be installed. This is particularly true when the door stop in an existing location is damaged or torn out of the wall or floor, thereby rendering the location inoperable without repairing the wall, which would take considerable time and effort. Relocating the door stop adjacent the previous location in a quick and easy manner, especially by anyone who can operate a power tool, would be beneficial.

There has been attempts in the prior art to provide such a door stop with an integral driving means. U.S. Pat. No. 4,218,807 in the name of Snow, U.S. Pat. No. 1,394,889 in the name of Foedisch et al., U.S. Pat. No. 2,479,597 in the name of Anton, and U.S. Pat. No. 3,180,666 in the name of Jorgensen are certain published prior art that have dealt with the aforementioned problems. However, none of these references specifically incorporate all of the features of the present invention.

Accordingly, there exists a need for a means by which door stops can be more easily installed and removed without the disadvantages as described above. The development of the door stop with integral driving means fulfills this need.

SUMMARY OF THE INVENTION

The principles of the present invention provide for a device that enables a driving tool to be used in quickly and accurately installing a door stop. Such a device includes a baseplate, an appendage extending perpendicularly away from a first side of the baseplate and capable of insertion into a substrate, a center post extending perpendicularly away from a second side of the baseplate, and a drive member located at a terminal end of the center post. An engagement means is located on an outwardly facing side of the drive member which enables a driving tool to engage the drive member to insert the door stop within the substrate.

Another object of the present invention is to provide a cap capable of removable attachment to the center post terminal end and capable of fully covering the engagement means.

In certain other embodiments, the appendage is a threaded member with a self-tapping terminal point.

In yet certain other embodiments, the appendage and center post are aligned along a common bisecting centerline.

In certain embodiments, the center post has a flange portion located thereon and adjacent said drive member. In embodiments where the cap is present, an outer diameter of the cap and flange portion are coextensive.

It is appreciated that the engagement means can include any one (1) of a number of different embodiments. Such embodiments can include: a straight edge drive slot, a Phillips head drive slot, a hexagonal drive face, and a hexagonal drive slot.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
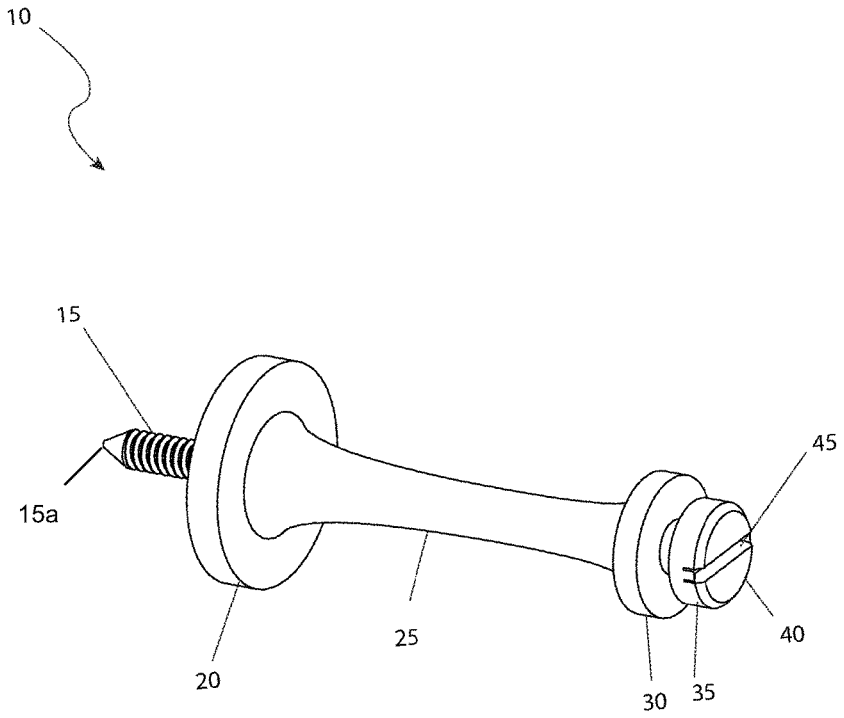
FIG. 1 is a perspective view of the door stop with integral driving means 10, according to the preferred embodiment of the present invention.

10 door stop with integral driving means
15 threaded appendage
20 baseplate
25 center post
30 outer flange
35 drive member
40 engagement means
45 standard screwdriver slot
50 rubber stop cap
55 baseboard
60 standard straight screwdriver
65 rotational travel path
70 Philips head screwdriver slot
75 hexagonal drive face

80 ratchet wrench
85 specialty drive slot

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, a front view of the door stop with integral driving means 10, according to the preferred embodiment of the present invention is disclosed. The door stop with integral driving means 10 (herein also described as the "device") 10, includes a threaded appendage 15 which is inserted into the baseboard 55 (not shown in this figure). The threaded appendage 15 is mounted on the rearward side of a baseplate 20 which abuts the baseboard 55 (not shown in this figure) and serves as a fastening point by means of friction. The threaded appendage 15 includes a centered spike 15*a* that allows the threaded appendage 15 to be cleanly driven into a surface (not shown) to facilitate screwing the threaded appendage 15 into the surface. The centered spike 15*a* is unthreaded to further facilitate allows the threaded appendage 15 to be cleanly driven into a surface (not shown) to facilitate screwing the threaded appendage 15 into the surface. A center post 25 then extends outward and terminates at an outer flange 30. A drive means 35 is then provided on the distal face of the outer flange 30 and serves two (2) purposes. Firstly, the drive member 35 is provided with an engagement means 40, in this case, a standard screwdriver slot 45 by which a tool may be used to provide increased leverage and make it easy to drive the device 10 into any type of hardwood. Secondly, the drive member 35 provides a means to snap on a rubber stop cap 50, (not shown in this figure), which not only hides the aesthetically unappealing view of the drive member 35 but provides a soft cushioned surface to protect any door which should strike the device 10 and dampen associated sound. It is envisioned that all components of the device 10 as shown in FIG. 1, including the threaded appendage 15, the baseplate 20, the center post 25, the outer flange 30, the drive member 35, and the engagement means 40, would be made of various metals such as steel, aluminum, brass, or the like in a one-piece design using various well-known metal casting and/or finishing processes.

The actual physical design is open to unlimited artistic interpretations, thus the design portrayed in this figure as well as following figures is not intended to be a limiting factor of the present invention. Only the teachings of a linear function extending from a baseboard 55 (not shown in this figure) with a drive member 35 that is subsequently covered by a rubber stop cap 50 (not shown in this figure).

Figure 2:
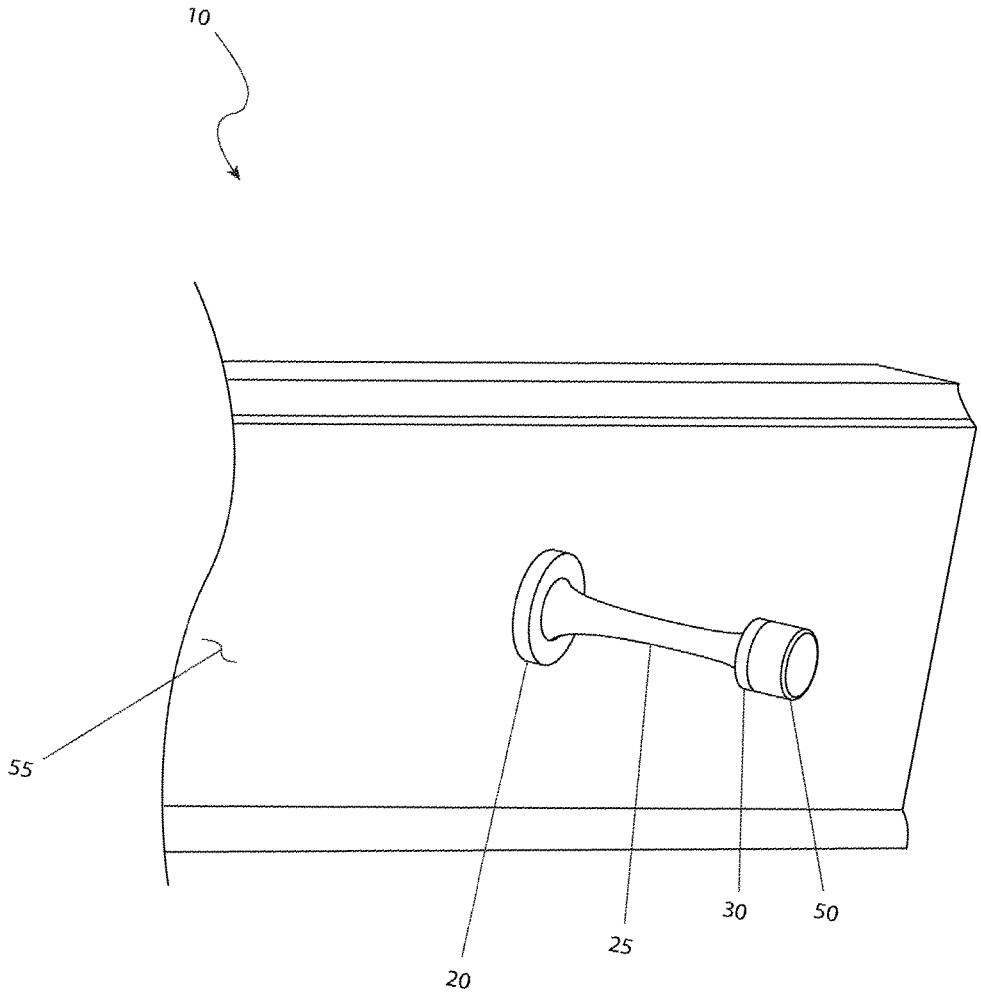
FIG. 2 is a perspective view of the door stop with integral driving means 10, shown in a utilized state, according to the preferred embodiment of the present invention.

Referring next to FIG. 2, a perspective view of the device 10, shown in a utilized state, according to the preferred embodiment of the present invention is depicted. The device 10 is shown with its baseplate 20 abutting a baseboard 55, installed in a customarily expected position. The baseplate 20 then supports the center post 25 in a horizontal manner, with the outer flange 30 in an outward position and the rubber stop cap 50 installed over the drive member 35 (not shown in this figure due to illustrative limitations. The rubber stop cap 50 is installed by simply pushing it over the drive means 35 (as shown in FIG. 1) where it remains in place by friction fit. Should removal of the rubber stop cap 50 be required, it is simply pulled off. The rubber stop cap 50 protects the entire drive member 35 and the outer flange 30 to fully protect the entire drive member 35 and the outer flange 30.

Figure 3A:
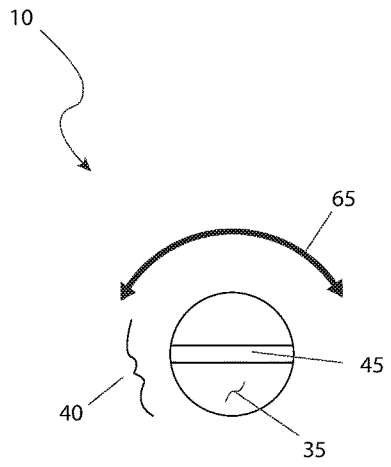
FIG. 3*a* is an end view of the door stop with integral driving means 10, with a standard screwdriver slot 45, according to one embodiment of the present invention.

Referring now to FIG. 3*a*, an end view of the device 10, with a standard screwdriver slot 45, according to one (1) embodiment of the present invention is shown. This figure is that previously depicted in FIG. 1. The standard screwdriver slot 45 is provided on the outward face of the drive member 35 and serves as the engagement means 40. Such an embodiment would be used with a standard straight screwdriver 60 (not shown in this FIGURE) to tighten or loosen the device 10 along a rotational travel path 65.

Figure 3B:
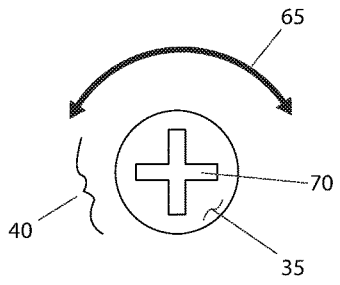
FIG. 3*b* is an end view of the door stop with integral driving means 10, with a Philips head screwdriver slot 70, according to another embodiment of the present invention.

Referring next to FIG. 3*b*, an end view of the device 10, with a Philips head screwdriver slot 70, according to another embodiment of the present invention is disclosed. The Philips head screwdriver slot 70 is provided on the outward face of the drive member 35 and serves as the engagement means 40. Such an embodiment would be used with a standard Philips screwdriver (not shown in this figure) to tighten or loosen the device 10 along a rotational travel path 65.

Figure 3C:
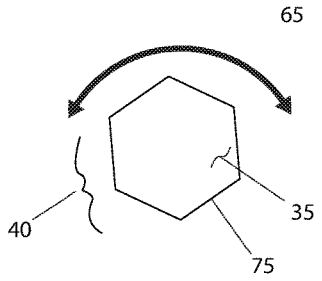
FIG. 3*c* is an end view of the door stop with integral driving means 10, with a hexagonal drive face 75, according to yet another embodiment of the present invention.

Referring now to FIG. 3*c*, an end view of the device 10, with a hexagonal drive face 75, according to yet another embodiment of the present invention is depicted. The hexagonal drive face 75 is provided on the perimeter face of the drive member 35 and serves as the engagement means 40. Such an embodiment would be used with a ratchet wrench 80 (not shown in this figure) to tighten or loosen the device 10 along a rotational travel path 65.

Figure 3D:
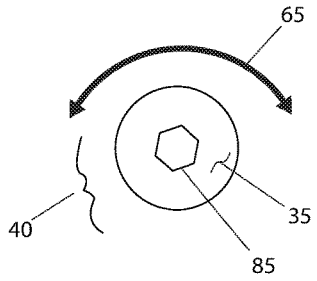
FIG. 3*d* is an end view of the door stop with integral driving means 10, with a specialty drive slot 85, according to yet another embodiment of the present invention.

Referring next to FIG. 3*d*, an end view of the device 10, with a specialty drive slot 85, according to yet another embodiment of the present invention is shown. The specialty drive slot 85 is provided on the outward face of the drive member 35 and serves as the engagement means 40. The specialty drive slot 85 is envisioned to include but not be limited to: an Allen wrench drive, torx drive, security fastener drive, or the like. The inclusion or omission of any particular type of drive means is not intended to be a limiting factor of the present invention. Such an embodiment would be used with a specialty drive device, (not shown in this figure) to tighten or loosen the device 10 along a rotational travel path 65.

Figure 4:
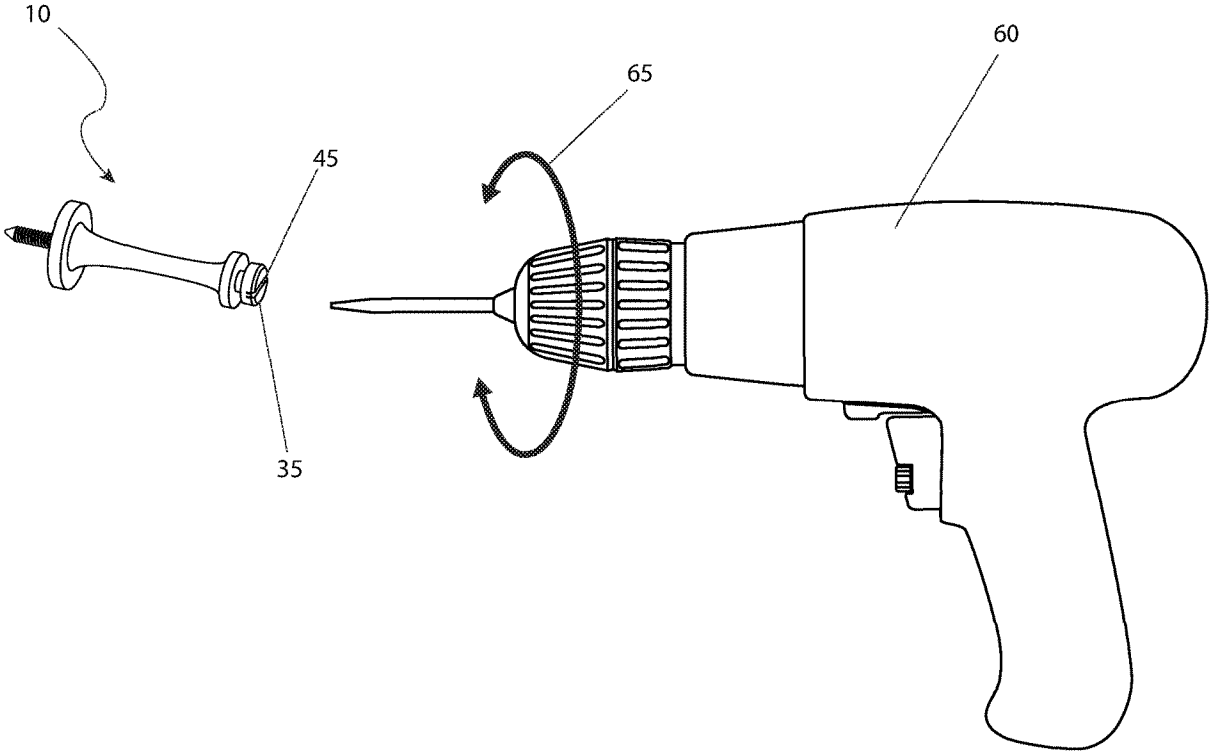
FIG. 4 is a perspective view of the door stop with integral driving means 10, being installed with a standard straight screwdriver 60, according to the preferred embodiment of the present invention.

Referring now to FIG. 4, a perspective view of the device 10, being installed with a standard straight screwdriver 60, according to the preferred embodiment of the present invention is disclosed. The standard straight screwdriver 60 is used to engage the standard screwdriver slot 45 on the drive member 35 whereupon it is driven inward or outward dependent on the direction of the rotational travel path 65 in much the same manner as a conventional wood screw. This motion is used during initial installation of the device 10, removal of the device 10, or any subsequent re-installation of the device 10.

Figure 5:
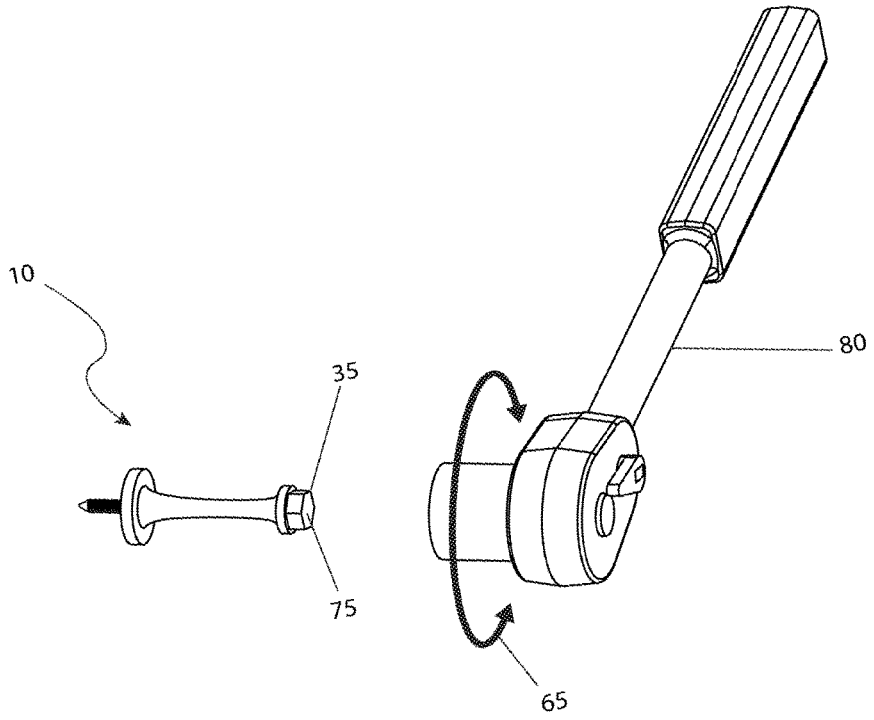
FIG. 5 is a perspective view of the door stop with integral driving means 10 being installed with a ratchet wrench 80, according to the preferred embodiment of the present invention.

Referring finally to FIG. 5, a perspective view of the device 10 being installed with a ratchet wrench 80, according to the preferred embodiment of the present invention is depicted. The ratchet wrench 80 is used to engage the hexagonal drive face 75 on the drive member 35 whereupon it is driven inward or outward dependent on the direction of the rotational travel path 65 in much the same manner as a conventional wood screw. This motion is used during initial installation of the device 10, removal of the device 10, or any subsequent re-installation of the device 10.

The preferred embodiment of the present invention can be utilized by the common user in a simple and effortless manner with little or no training. It is envisioned that the device 10 would be constructed in general accordance with FIG. 1 through FIG. 5.

The user would procure the device 10 through normal procurement channels with regards to overall length of the device 10 as well as the aesthetic properties of the device 10 such as design, color, style and the like so as to blend with the décor of the space in which the device 10 is utilized in.

During initial installation of the device 10, the following procedure would be initiated: a hole would be drilled in the baseboard 55 at the desired location; the rubber stop cap 50 would be removed; the threaded appendage 15 would be engaged in the previously drilled hole by hand, a driving means such as a standard straight screwdriver 60, a ratchet wrench 80, a Philips screwdriver, a specialty driver, a wrench or the like would be engaged upon the engagement means 40 of the drive member 35; the device 10 would be turned along a rotational travel path 65 to drive the device 10 into the baseboard 55 until the baseplate 20 is seated against the baseboard 55; the driving means removed; and the rubber stop cap 50 placed over the drive member 35.

During removal of the device 10, the following procedure would be utilized: the rubber stop cap 50 would be removed; a driving means as described above would be engaged upon the engagement means 40 of the drive member 35; and the driving means rotated along a rotational travel path 65 to remove the device 10 from the baseboard 55.

Should reinstallation be desired, such after painting, remodeling, or the like, the initial installation process as described above would be followed with the exception of omitting the process of drilling the initial hole. The removal or reinstallation may continue as needed in a cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A door stop, comprising:

a baseplate;

an appendage extending perpendicularly away from a first side of said baseplate and inserted into a substrate, said appendage includes a centered spike that allows said appendage to be cleanly driven into a surface to facilitate screwing said appendage into said surface, said centered spike is unthreaded to further facilitate allows said appendage to be cleanly driven into said to facilitate screwing said threaded appendage into said surface;

a center post extending perpendicularly away from a second side of said baseplate, opposite said first side;

a drive member located at a terminal end of said center post, opposite said baseplate second side, said drive member further comprising an engagement means on an outward facing side thereof, said engagement means enabling a driving tool to engage said drive member to insert said door stop within said substrate; and, a cap removably attached to said center post terminal end and fully covering said engagement means, said cap protects entire said drive member and an outer flange;

wherein said engagement means is a straight edge drive slot, a Phillips head drive slot, a hexagonal drive face, or a hexagonal drive slot.

2. The door stop of claim 1, wherein said appendage and said center post are aligned along a common bisecting centerline.

3. The door stop of claim 1, wherein an outer diameter of said cap and an outer diameter of said flange portion are coextensive.

* * * * *